US009260895B1

(12) United States Patent
Jewett

(10) Patent No.: US 9,260,895 B1
(45) Date of Patent: Feb. 16, 2016

(54) WINDOW SECURITY DEVICE

(71) Applicant: Richard H. Jewett, Kissimmee, FL (US)

(72) Inventor: Richard H. Jewett, Kissimmee, FL (US)

( * ) Notice: Subject to any disclaimer, the term of this patent is extended or adjusted under 35 U.S.C. 154(b) by 0 days.

(21) Appl. No.: 14/640,233

(22) Filed: Mar. 6, 2015

(51) Int. Cl.

| | |
|---|---|
| ***E05C 19/18*** | (2006.01) |
| ***E05C 17/44*** | (2006.01) |
| ***E05C 17/54*** | (2006.01) |
| *E05B 65/08* | (2006.01) |

(52) U.S. Cl.
CPC ..... *E05C 17/44* (2013.01); *E05C 17/54* (2013.01); *E05B 65/0888* (2013.01); *E05B 65/0894* (2013.01)

(58) Field of Classification Search
CPC . E05B 65/0888; E05B 65/0894; E05C 17/49; E05C 17/54; E05C 17/44
USPC ..... 292/1, 288, 259 R, 262, 289, 338, 339, 292/342, 343, DIG. 15, DIG. 20, DIG. 61, 292/DIG. 46, DIG. 47; 49/449
See application file for complete search history.

(56) References Cited

U.S. PATENT DOCUMENTS

| | | | | |
|---|---|---|---|---|
| 193,992 | A * | 8/1877 | Patterson | 292/63 |
| 250,531 | A * | 12/1881 | Heckler | 135/80 |
| 519,840 | A * | 5/1894 | Edsall | 211/105.6 |
| 536,272 | A * | 3/1895 | Edsall | 211/105.6 |
| 647,986 | A * | 4/1900 | Roberts | 211/105.6 |
| 1,168,491 | A * | 1/1916 | Ellis | 292/288 |
| 1,360,628 | A * | 11/1920 | Claude Ellis | 292/288 |
| 1,425,247 | A * | 8/1922 | Galbreath | 211/105.6 |
| 1,425,515 | A * | 8/1922 | Ellis | 292/288 |
| 2,912,268 | A | 11/1959 | Markovich | |
| 3,001,754 | A * | 9/1961 | Fowler | 248/357 |
| 3,781,046 | A * | 12/1973 | Hinkle | 292/264 |
| 4,152,018 | A * | 5/1979 | Cantrell | 292/305 |
| 4,461,502 | A * | 7/1984 | Burgess | 292/262 |
| 4,792,168 | A | 12/1988 | Kardosh | |
| 5,102,173 | A * | 4/1992 | Schallern | 292/288 |
| 5,669,641 | A | 9/1997 | Jeansonne | |
| 5,685,582 | A | 11/1997 | McCartney | |
| 5,872,514 | A * | 2/1999 | Neas | 340/545.1 |
| 8,479,932 | B2 * | 7/2013 | Carney | 211/105.5 |
| 2005/0212309 | A1 * | 9/2005 | Mayer | 292/343 |
| 2007/0209414 | A1 * | 9/2007 | Bentley et al. | 70/312 |
| 2008/0092451 | A1 * | 4/2008 | Famulare et al. | 49/449 |

FOREIGN PATENT DOCUMENTS

DE 3936203 A1 * 5/1991

* cited by examiner

*Primary Examiner* — Kristina Fulton
*Assistant Examiner* — Christine M Mills
(74) *Attorney, Agent, or Firm* — Larry D. Johnson

(57) ABSTRACT

A removable window security device includes a base unit with a silicone plug and an internal compression spring, which supports a custom-length upper portion capped with a non-slip rubber cap. The silicone plug serves as a pad for the compression spring and a non-slip bottom for the base unit. The assembled device is positioned in the window between the sashes, preventing the window from being opened.

4 Claims, 3 Drawing Sheets

WINDOW SECURITY DEVICE

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates generally to home security devices, and more specifically to a window security device of the type that may be used for the protection of residential windows against intruders using a pry-bar.

BACKGROUND INFORMATION AND DISCUSSION OF RELATED ART

Homes can be burglarized by prying open a window that is locked, including windows with a thumbscrew security device securely attached. Some homeowners attempt to secure a window by fitting a 1" by 2" stick or other brace in such a way that it would prevent the window from being "jimmied" open or the prop falling out or being dislodged. This is a poor solution in addition to being dangerous in case of fire. There are other window security products that are designed to be an adjustable prop, but they only work well in a horizontal position.

U.S. Pat. No. 4,792,168 to Kardosh discloses an adjustable safety block assembly which can be used to traverse an opening for a sliding door in order to block it. The assembly consists of inner and outer tubular members which can be telescoped together. One of the tubular members has a series of axially extending rows of holes spaced at even intervals, and staggered around the radius of the two. The other tubular member has groups of evenly axially spaced circumferentially distributed holes radially arranged. The tubular members may be telescoped until the desired length is achieved, and then holes of the inner and outer tubular members aligned so that locking means can be inserted through the aligned holes to fix the tubular members in relative position, to form a rigid bar. Thus, the safety block is easily adjustable to accommodate any patio door widths, and may be disassembled for storage and travel.

U.S. Pat. No. 5,669,641 to Jeansonne describes a door securing system including a pivot anchor; a latch anchor; a telescoping cross-bar having a pivot section that is slidingly and rotatably received within a tubular latch section; and an adjustable door contact assembly including a contact securing mechanism securable to and positionable along at least a securing section of the latch section and a user positionable bumper plate that is positionable in a plurality of user selected distances away from the latch section. In use, the cross-bar is held in place across the door to be secured by the pivot anchor and the latch anchor and the bumper plate locked into contact with the door surface to prevent opening of the door.

U.S. Pat. No. 5,685,582 to McCartney teaches a security lock for a sliding door or window assembly. The lock comprises two pivotally connected overlapping bars having a releasable slider mechanism associated with the pivot point. The lock is adapted to sit in or above the track along which the sliding door or window moves.

The foregoing patents reflect the current state of the art of which the present inventor is aware. Reference to, and discussion of, these patents is intended to aid in discharging Applicant's acknowledged duty of candor in disclosing information that may be relevant to the examination of claims to the present invention. However, it is respectfully submitted that none of the above-identified patents disclose, teach, suggest, show, or otherwise render obvious, either singly or when considered in combination, the invention described and claimed herein.

SUMMARY OF THE INVENTION

The present invention provides a removable window security device including a base unit with a silicone plug and an internal compression spring, which supports a custom-length upper portion capped with a non-slip rubber cap. The silicone plug serves as a pad for the compression spring and a non-slip bottom for the base unit. The assembled device is positioned in a window between the sashes, preventing the window from being opened.

This invention provides a universal device to secure a window that is customizable, can be used in many different window sizes, and can be easily removed and used in a different window. It is used to secure a window so that it cannot be opened for the prevention of unwanted intruders into a home, business or other type of building. In particular, the invention prevents forced entry through single or double hung sash-type windows.

The invention is a window jamming device designed to stay positioned in place to prevent the forced opening and entry of a window. To minimize shipping costs, the inventive device may be offered as a "do-it-yourself" kit with the customer providing the upper portion in the suitable length of ½" PVC S-40 pipe for windows (vertical installation), or ½" iron pipe for sliding doors (horizontal installation). A customized length upper portion also provides customers the opportunity to increase or decrease the degree of spring compression desired.

Residential windows are typically manufactured with single or double-hung sash type windows where one sash remains stationary and the other sash is movable along a set of side stiles in the window frame. Unfortunately, home burglaries are made easy when all the thief needs is a pry-bar to gain entry by forcing up the lower sash window. The inventive device is installed into a sash type window between the upper portion of the meeting rail of a lower sash window and the bottom portion of the head of the window frame.

The present invention will block or jam these types of forced entries and intrusions. It is easy to install, easy to remove, easy to re-install, and easy to reconfigure for different windows in different locations. The inventive window security device will not damage window frames and is adaptable to any type of window frame material such as wood, vinyl, or aluminum.

The completed security device is positioned in the window by placing the bottom of the base onto the upper surface of the window meeting rail and then pulling downward on the plastic loop provided to compress the spring so that the device can be positioned to fit between the upper surface of the lower sash and the lower surface of the upper sash, being positioned up against either side of the window frame. Once in place, the device will prevent the window from being opened. The force generated by the lower sash being pried or forced up is translated along the length of the device into the lower surface of the window frame head. Even if the lower sash is movable by a small amount, the spring compression becomes even stronger, making this window "jimmy-proof".

Nearly any two surfaces which are parallel to each other and include flat facing surfaces could potentially be made resistant to opening forces by the present invention. The present invention when placed along the side portion of the window frame will be unobtrusive and easily disguised with curtains or blinds. It is a security device that could be provided by landlord and renter alike due to low cost and ease of installation. The device of the present invention is easily removed by an occupant of a building needing to open the window quickly, such as in the case of a fire emergency.

Features and advantages of the inventive device include, but are not limited to, the following:

Prevents windows from being jimmied-open.

Works on aluminum, vinyl, or wood-frame windows.

It can be produced as a do-it-yourself kit that requires purchaser to measure and cut a ½" section of PVC pipe.

It is easy and quick to install.

Will work on all windows.

It is safe to use as instructed.

It can be moved from window to window.

It can be moved from house to house.

It is easily removed from inside (an important safety feature).

It will not harm your windows.

It does not require any attachment.

Instructions are simple.

It is unobtrusive.

It is therefore an object of the present invention to provide a new and improved window security device.

It is another object of the present invention to provide a new and improved window security device for the protection of residential windows against intruders using a pry-bar.

A further object or feature of the present invention is a new and improved window security device that is easy to install.

An even further object of the present invention is to provide a novel window security device that is easily removed when necessary.

Other novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration and description only and are not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
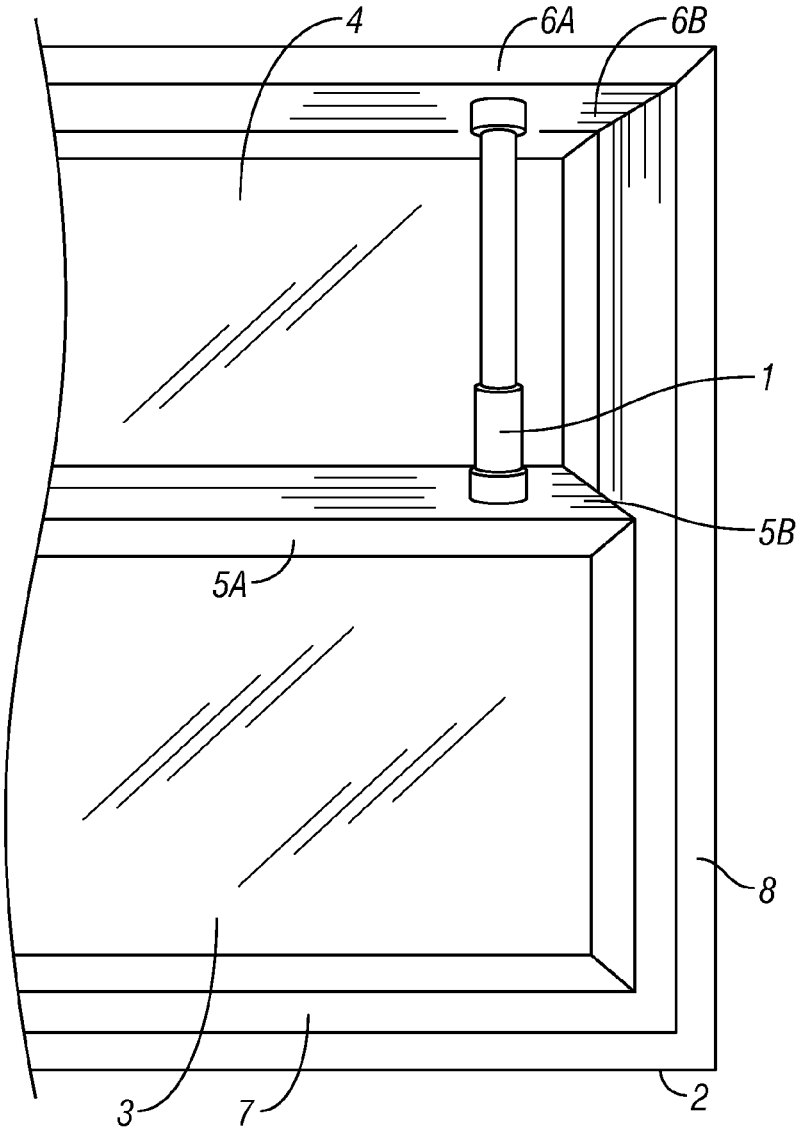
FIG. 1 is a view of a window security device of this invention installed in a typical sash-type window.

Referring to FIGS. 1 through 4B, wherein like reference numerals refer to like components in the various views, there is illustrated therein a new and improved window security device, generally denominated 1 herein.

FIG. 1 shows the window security device 1 of this invention positioned in place in a typical sash type window 2 with window frame sill 7 and window frame head 6A. The lower sash window 3 has an upper surface 5B of center meeting rail 5A which runs horizontally and planar to the lower surface 6B of the window frame head 6A of the window frame 8.

The upper portion of the window security device 1 is in contact with the lower surface 6B of the window frame head 6A of the window frame 8, while the bottom portion of the window security device 1 is in contact with the upper surface 5B of the meeting rail 5A of the lower sash window 3. In this example, the lower sash window 3 is movable up and down within the window frame 2, but is prevented from opening by installation of the inventive security device.

An upper sash window 4 is positioned behind the lower sash window 3 providing the recessed area in which the window security device 1 can be located. In windows where the upper sash window is positioned in front of the lower sash window, the security device is of course placed between the window sill and the upper sash window.

Figure 2:
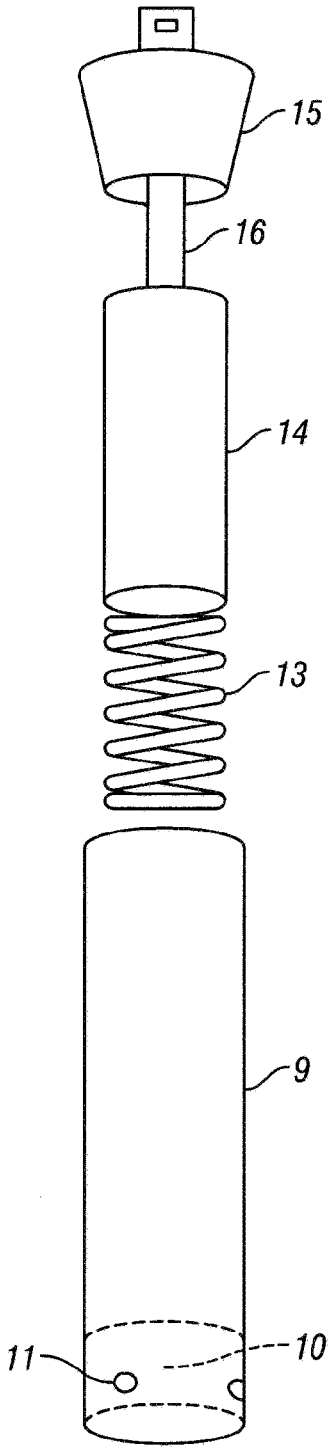
FIG. 2 is an exploded view of a window security device.

FIG. 2 shows the window security device 1 having a base unit 9 which includes a silicone plug 10 which extends at least some distance below the bottom end of the base unit, and also through one or more adherence holes 11 (e.g., four holes, 3/16 inch diameter) located proximate the bottom end of the base unit. This is a perfect base to support spring pressure, in that the more force that is applied the stronger the base becomes. The applied silicone pad is also the perfect non-slip surface for the base unit. The silicone plug 10 may be formed from white or clear silicone material approximately 5/8" thick, and which will not damage any surface that supports it.

Base unit 9 is preferably made from a segment of 3/4" thin-wall PVC pipe (e.g., 4" in length). The PVC is exemplary and other materials such as wood, or metal could be used. A compression spring 13 is located within the central bore of the pipe segment to provide a compression and extension of the window device 1. It can be a #48 compression spring of approximately 0.737-inch diameter, typically comprised of metal.

The creation of the silicone base which supports the compression spring and provides a non-slip surface for the base unit is unique, in that the more pressure applied by the spring against this silicone plug, the more resistant it becomes to applied pressure. This is accomplished by drilling four (or more) 3/16" holes through the PVC base unit and pushing the silicone mixture to extend outward through the holes to form a strong pad of silicone. Once cured, pressure applied to this silicone base will increase these silicone tabs, adding to its structural strength.

Upper portion 14 may be made from a segment of narrower pipe (e.g., 1/2" PVC pipe, or of a diameter to slide within the base unit), cut to specific lengths according to the application and then inserted into the base unit such that the bottom end contacts the compression spring 13 and can apply a compression force to the spring 13. Rubber cap 15 fits over the top of upper portion 14. Wire tie 16 (e.g., 11" long) is inserted through a hole in the rubber cap, to later be formed into a handle for the device as described below. The length of the upper portion 14 is selected so that the assembled unit tightly fits within the window to be secured, and can be adjusted by cutting to optimize the compression and strength of the window security device.

Figure 3:
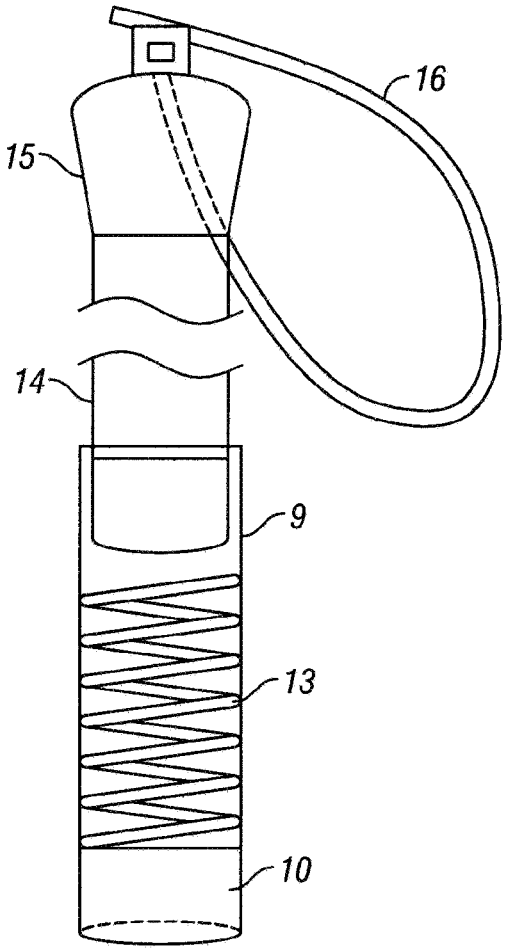
FIG. 3 is a cross section view of a window security device.

FIG. 3 shows a cross section of base unit 9 showing the compression spring 13 located in the pipe bore. The upper portion 14 is movable within the base unit such that the spring contraction or expansion affects the position of the upper portion 14. The overall length of the base unit 9 maintains the position of the compression spring so that it does not move out of the pipe bore and stays anchored within the base unit.

Wire tie 16 is shown looped and secured to the rubber cap 15, forming a handle that can be used to remove the security device from an installed position in a window.

Figure 4A:
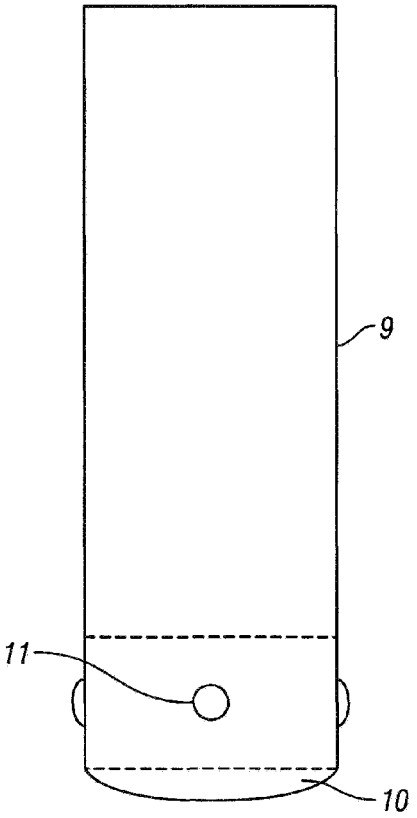
FIG. 4A is a side elevation view of the base unit of a window security device before installation.
Figure 4B:
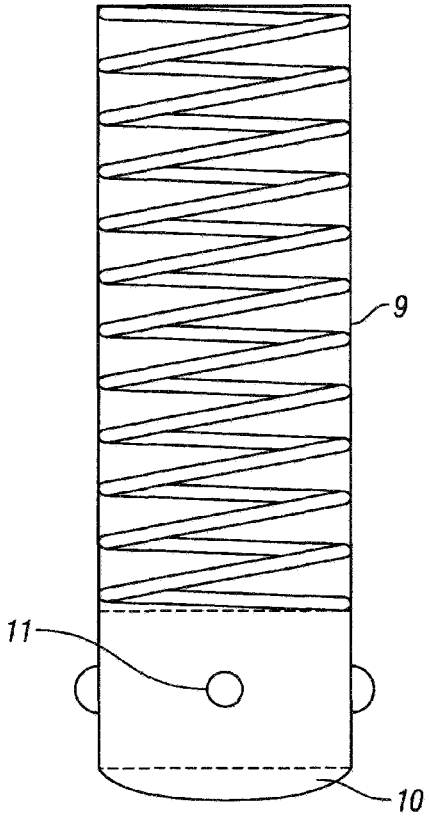
FIG. 4B is a side elevation view of a base unit under applied pressure from the compression spring, showing the expansion of the silicone plug.

FIG. 4A is a side elevation view of a base unit 10 before installation, showing the silicone plug 10 before expansion. FIG. 4B is a side elevation view of the base unit under applied pressure from the compression spring 13 (e.g., 12 to 15 pounds pressure), showing the expansion of the silicone plug through the adherence holes 11.

The inventive device is designed to protect any single or double-hung window from being "jimmied" or pried open. With this window protection, a determined burglar will be forced to "break and enter". When burglars are forced to break and enter, they assume that they have a very limited few minutes to locate and gather up your valuables, resulting in limited loss and evidence left behind that may lead to their arrest.

The inventive device may be manufactured so that the purchaser provides their own section of 1/2" PVC or iron pipe for the upper portion, cut to proper length that when installed will keep the window or "slider" door from being pried open. The device is safe to use because it is easily removed from inside and can be moved from room to room if need be. The device is especially effective placed in residences that are protected by security systems when zone motion detection is not activated.

The invention thus provides a supplemental security device intended to bolster security measures against a specific (but most dangerous) type of intruder, the so-called "cat burglar".

Accordingly, the inventive device may be characterized as a window security device for sash-type windows having a movable sash window in a window frame, comprising a base unit having a central bore and a bottom end; a silicone plug in the central bore and extending at least some distance below the bottom end; a compression spring in the central bore contacting the silicone plug; an upper portion having a top end and slidable within the base unit central bore to engage the compression spring; and a cap on the upper portion top end, wherein the device can be installed in a window to span between the movable sash window and the window frame to prevent the movable sash window from opening. The base unit may include one or more adherence holes located proximate the bottom end, such that the silicone plug expands through the adherence holes when the upper portion applies pressure to the compression spring. Also, the upper portion cap may include a handle to facilitate sliding of the upper portion into the base unit to shorten the overall length of the device for ease of installation into and removal from a window.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A window security device for sash-type windows having a movable sash window in a window frame, the device comprising:

a base unit having a central bore and a bottom end, said base unit including one or more adherence through holes located proximate said bottom end;

a silicone plug in said central bore and extending at least some distance below said bottom end and through said one or more adherence through holes in said base unit to form one or more silicone tabs;

a compression spring in said central bore contacting said silicone plug;

an upper portion having a top end and slidable within said base unit central bore to engage said compression spring; and a cap on said upper portion top end, wherein said one or more silicone tabs expand through said one or more adherence through holes in said base unit when said upper portion applies pressure to said compression spring, and said device can be installed in a window to span between the movable sash window and the window frame to prevent the movable sash window from opening.

2. The window security device of claim 1 wherein said base unit is constructed from PVC pipe.

3. The window security device of claim 1 wherein said upper portion is constructed from PVC pipe.

4. The window security device of claim 1 wherein said upper portion cap includes a handle to facilitate sliding of said upper portion into said base unit to shorten the overall length of said device for ease of installation into and removal from a window.

* * * * *